US007451505B2

(12) United States Patent
Johannsen

(10) Patent No.: US 7,451,505 B2
(45) Date of Patent: Nov. 18, 2008

(54) BED TILTING APPARATUS

(76) Inventor: Jurgen Johannsen, Wellingsbuettler Weg 77, Hamburg (DE) 22391

( * ) Notice: Subject to any disclaimer, the term of this patent is extended or adjusted under 35 U.S.C. 154(b) by 315 days.

(21) Appl. No.: 11/183,443

(22) Filed: Jul. 18, 2005

(65) Prior Publication Data

US 2007/0011811 A1 Jan. 18, 2007

(51) Int. Cl.
*A61G 7/008* (2006.01)

(52) U.S. Cl. ..... 5/607; 5/611

(58) Field of Classification Search ..... 5/610, 5/600, 607, 609, 611
See application file for complete search history.

(56) References Cited

U.S. PATENT DOCUMENTS

| | | | | |
|---|---|---|---|---|
| 4,062,074 | A | 12/1977 | Holland | |
| 4,071,916 | A | 2/1978 | Nelson | |
| 4,084,274 | A | 4/1978 | Willis et al. | |
| 4,114,209 | A | 9/1978 | Sandlin | |
| 4,490,867 | A | 1/1985 | Gabrielsson | |
| 5,018,712 | A * | 5/1991 | Schaefer | 5/607 |
| 5,103,511 | A | 4/1992 | Sequin | |
| 5,181,288 | A | 1/1993 | Heaton et al. | |
| 5,410,768 | A | 5/1995 | Manson et al. | |
| 5,515,561 | A | 5/1996 | Suggitt et al. | |
| 5,860,899 | A * | 1/1999 | Rassman | 482/142 |
| 6,212,712 | B1 * | 4/2001 | Topp | 5/610 |
| 6,385,801 | B1 | 5/2002 | Watanabe | |

OTHER PUBLICATIONS

ProBed Medical Technologies, Inc., The Freedom Bed.

* cited by examiner

*Primary Examiner*—Alexander Grosz
(74) *Attorney, Agent, or Firm*—Emily E. Harris; Kent A. Herink

(57) ABSTRACT

A bed elevating apparatus is provided which includes a mechanism for elevating a longitudinal side of a bed while the other side remains in place and acts as a pivot. The act of alternating the side of the bed that is raised shifts the pressure between the person and the bed and thus helps to reduce or prevent bedsores. The bed elevating apparatus can be used with preexisting hospital or nursing home beds. The apparatus is placed between the bed frame and the lower legs portion of the bed such that the legs of the bed remain on the floor and only the bed frame is longitudinally raised.

16 Claims, 7 Drawing Sheets

BED TILTING APPARATUS

BACKGROUND OF THE INVENTION

The invention relates generally to a bed tilting apparatus and, more particularly, to an apparatus for titling or elevating the sides of a bed in order to shift and relieve pressure between a person and the bed.

When people are confined to a bed for extended periods of time, the lack of blood circulating as a result of the weight of the person pressing against the bed can lead to bed sores, pressure ulcers, Decubitus, and/or necrosis. A bedridden person must periodically shift or change positions in order to relieve the pressure between the person and the bed. Often an attendant is required to help periodically move the patient and thus relieve the pressure between the person and the mattress. Nurses or attendants generally slide wedge-shaped bolsters under alternating sides of the mattress to shift the person's position.

The problem of moving bed-ridden patients has also been previously addressed through the use of tilting or rocking beds. For example, in U.S. Pat. No. 4,071,916 and U.S. Pat. No. 4,490,867, the entire bed tilts longitudinally in order to move the patient. Previous solutions also include mattresses that are longitudinally divided into sections that tilt or pivot, such as that described in U.S. Pat. No. 4,084,274.

The need exists for a device to raise the sides of a bed longitudinally that does not require the entire bed to be lifted off of the ground. The need also exists for a device that could be used on preexisting beds such that ordinary hospital and nursing home beds could be converted into elevating beds.

SUMMARY OF THE INVENTION

In accordance with the present invention, a bed elevating apparatus is provided which includes a mechanism for elevating a longitudinal side of a bed while the other side remains in place and acts as a pivot. The act of alternating the side of the bed that is raised changes the pressure between the person and the bed and thus helps to reduce or prevent bedsores.

Accordingly, an object of the present invention is to provide a device for raising the sides of a bed.

A further object of the invention is to provide a device that will raise the longitudinal sides of a bed in order to shift the position of a person in the bed or the pressure between the person and the bed.

Another object of the present invention is to provide a device that can be used with existing beds to elevate the sides of the bed.

A further object of the present invention is to provide a bed elevating mechanism that elevates each side of a bed wherein the legs of the bed remain on the floor.

These and other objects of the invention will be understood by a person skilled in the art upon a review of the specification, the associated drawings, and the appended claims.

DETAILED DESCRIPTION OF THE INVENTION

Figure 1:
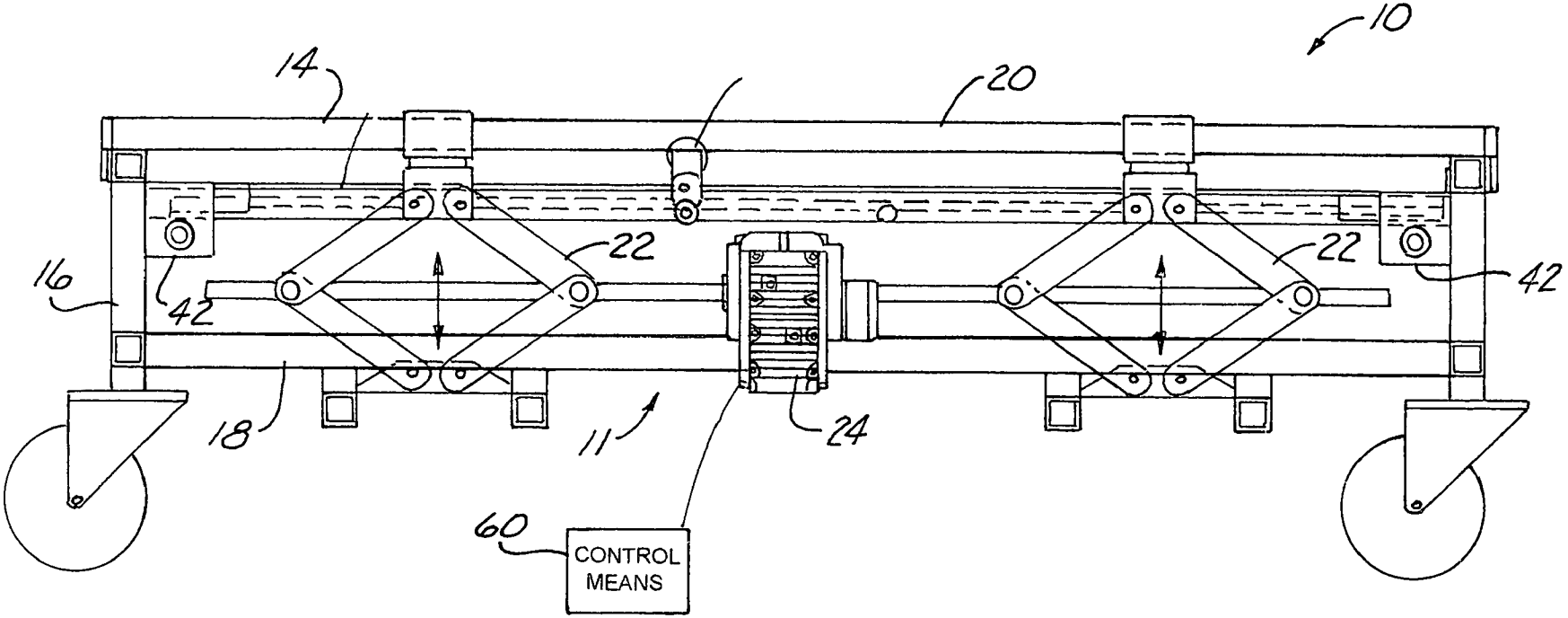
FIG. 1 is a side view of the elevating bed of the present invention.
Figure 2:
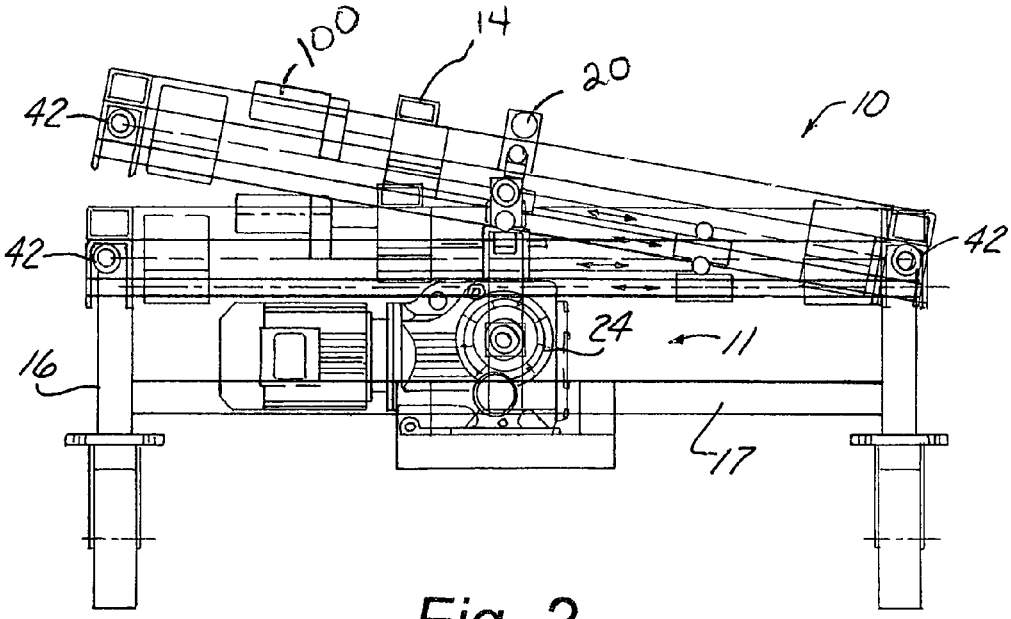
FIG. 2 is an end view of the elevating bed of the present invention depicting one the bed in the horizontal position and in the raised position.

Illustrated in FIG. 1 is a bed elevating apparatus 10 that raises a longitudinal side of a bed while the other side remains fixed in place to act as a pivot. Beds, especially those used in hospitals and nursing homes, generally have two main sections: a bed frame 14 and a lower section 16 (FIG. 2). Beds can also have a third section, a mattress support platform 12. When a bed has a mattress support platform 12, the mattress support platform is connected to the bed frame 14 and thus rises when the bed frame 14 rises. The lower section 16 includes the four bed legs. The legs at each end are transversely connected by end rods 17. The lower section also includes at least one longitudinal rod 18 which connects the two end rods 17.

Figure 3:
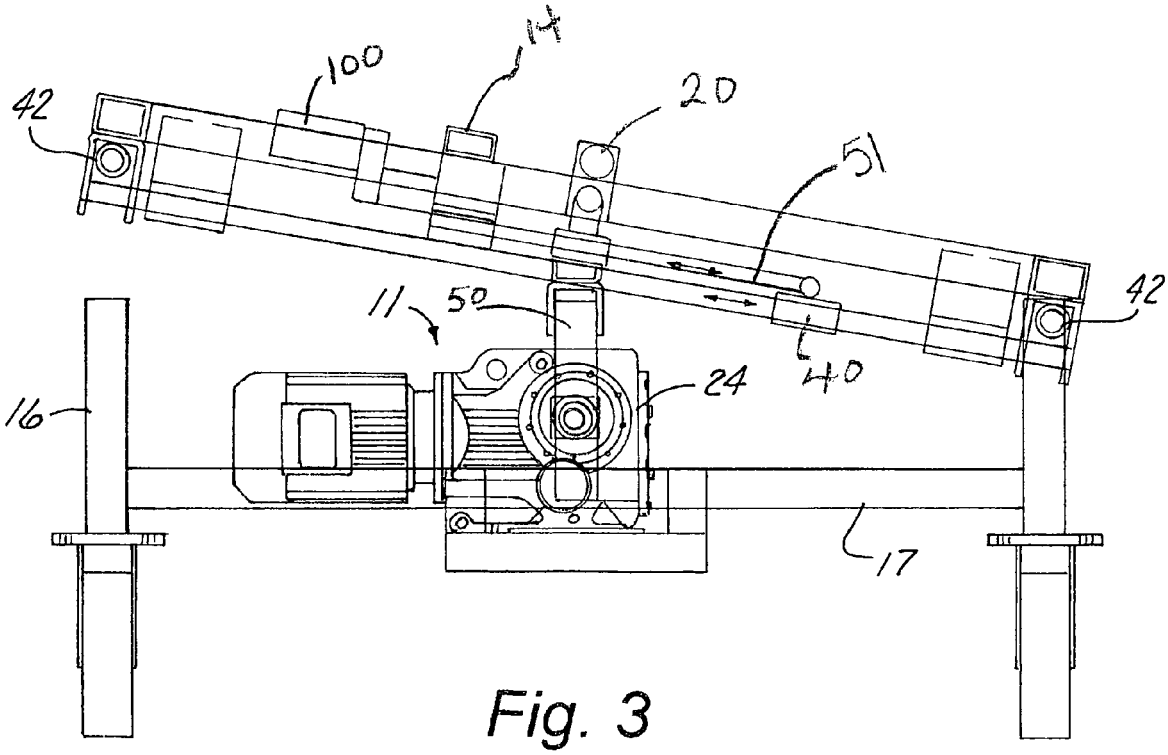
FIG. 3 is an end view of the elevating bed of the present invention showing one longitudinal side of the bed in a raised position.

In the present invention, a system for elevating each longitudinal side of a bed is presented. The mechanism 11 for elevating the bed is mounted between the bed frame 14 and the lower legs section 16 (FIGS. 1-3). The longitudinal rod 18 of the lower legs section is the base where the mechanism 11 for moving rests. In beds with a mattress support platform 12, the mattress support platform 12 is connected to the bed frame 14 so that movement of the bed frame 14 will also move the mattress support platform 12. The mechanism 11 for elevating the bed alternatively raises each longitudinal side of the bed by raising one side of the bed frame 14. The side that is not being raised remains in place and acts as a pivot (FIGS. 2-3).

Figure 7:
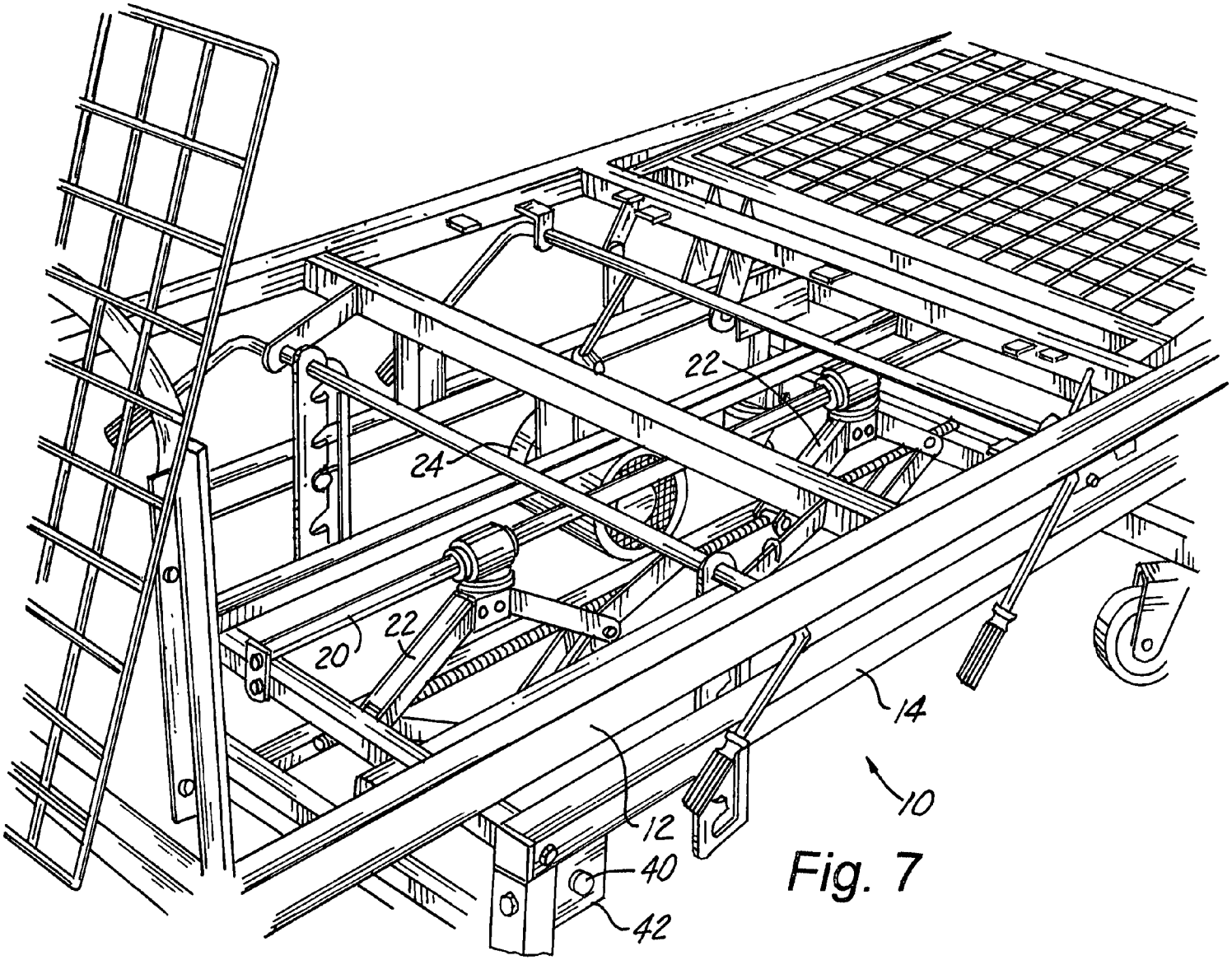
FIG. 7 is a perspective view of the elevating bed of the present invention.
Figure 8:
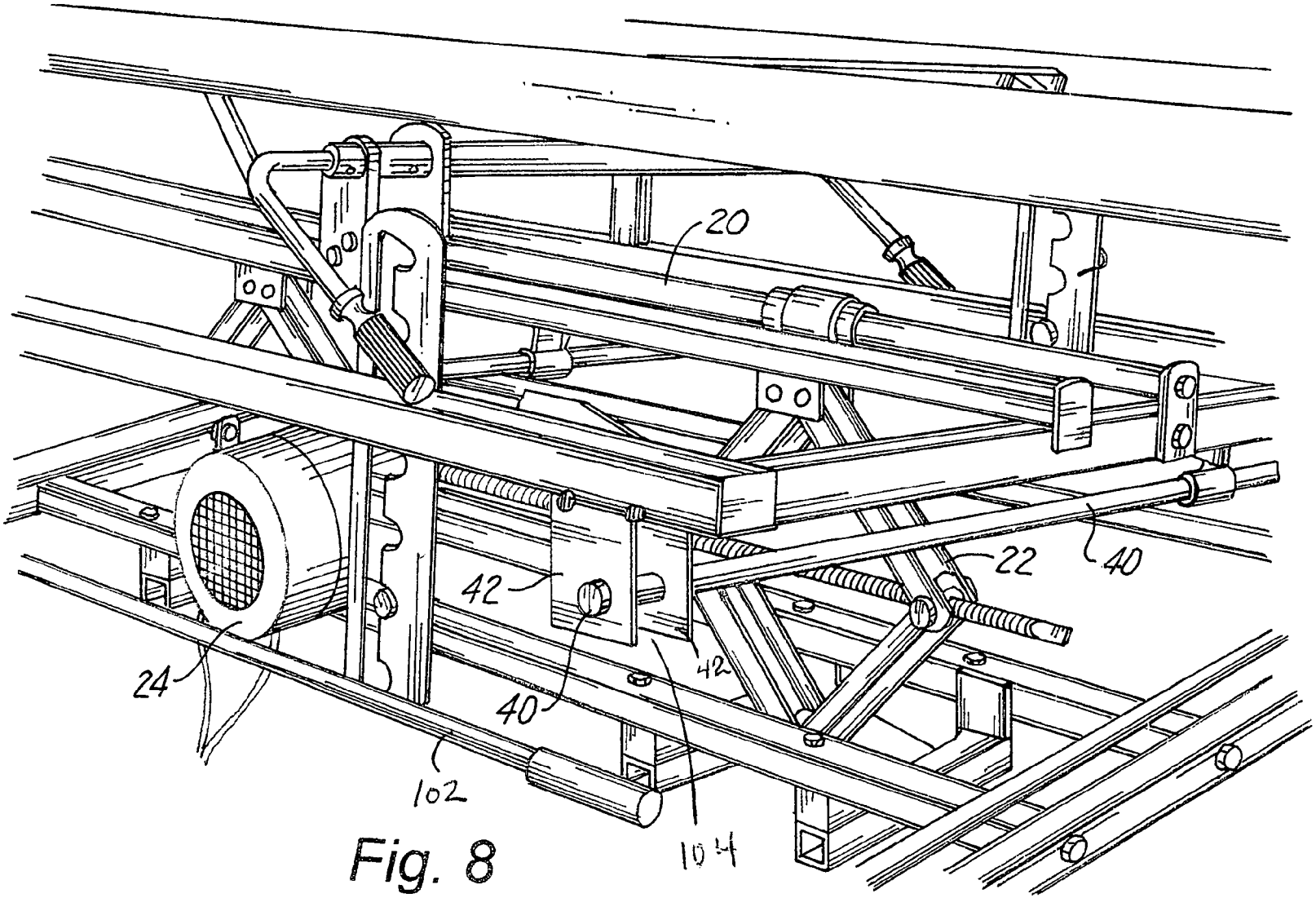
FIG. 8 is a view of the side of the tilting bed of the present invention

In one embodiment, as seen in FIG. 7, a lifting rod 20 is connected to the bed frame 14. The lifting rod 20 is raised and lowered by two scissor jacks 22. The scissor jacks 22 are mounted on the longitudinal rod 18 of the lower section 16 in a way to allow the scissor jacks enough movement to follow the arc of the bed frame 14 as it is raised and lowered. The scissor jacks 22 are operated by a spindle which is driven by an electric motor 24 (FIG. 8). The lifting rod 20 raises a side of the bed frame 14 and, thus the mattress support platform 12 is also raised. When the lifting rod 20 raises one side of the bed frame 14, the other longitudinal side remains in place as a pivot.

Figure 4:
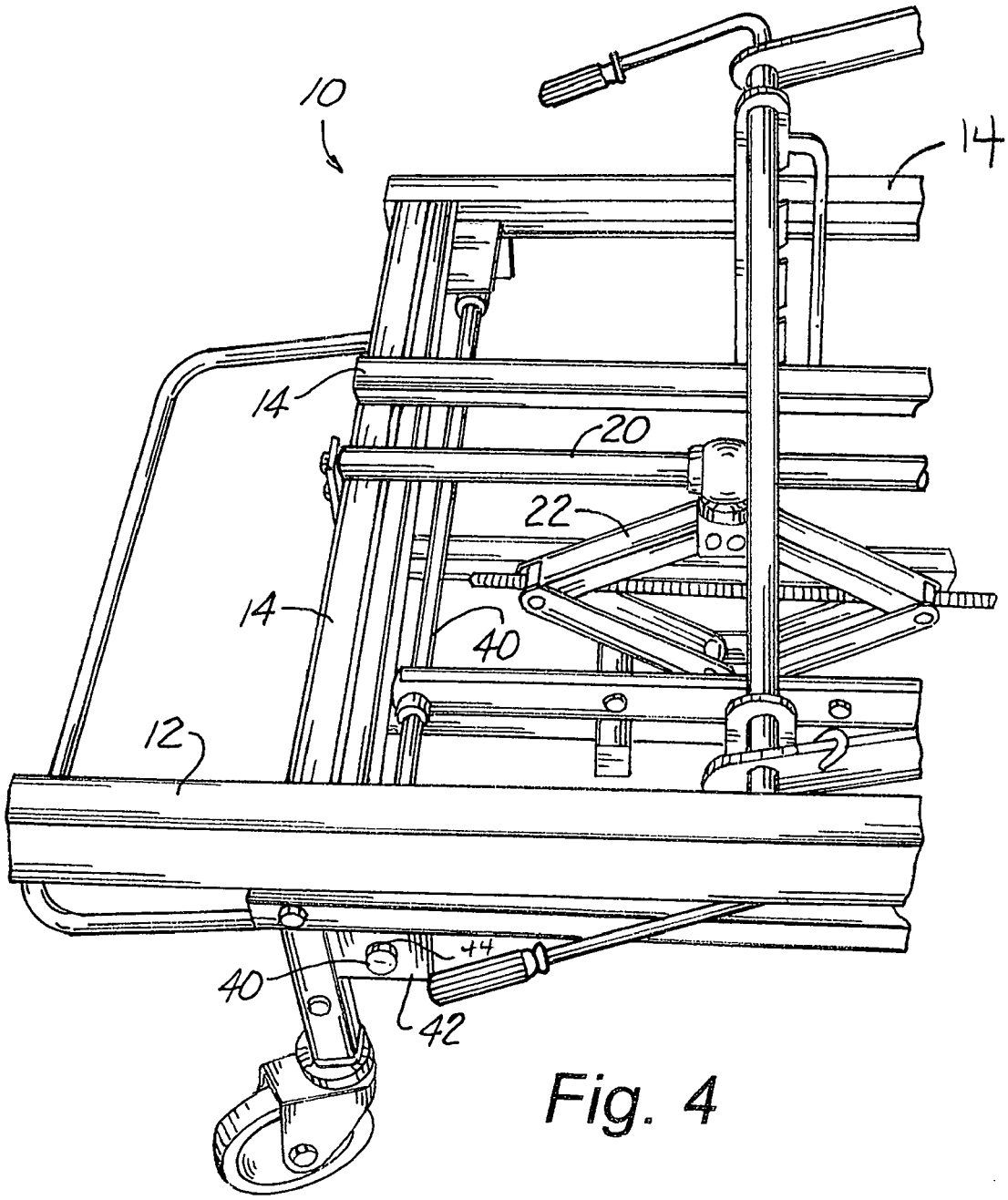
FIG. 4 is a view of an end of the elevating bed of the present invention.
Figure 5:
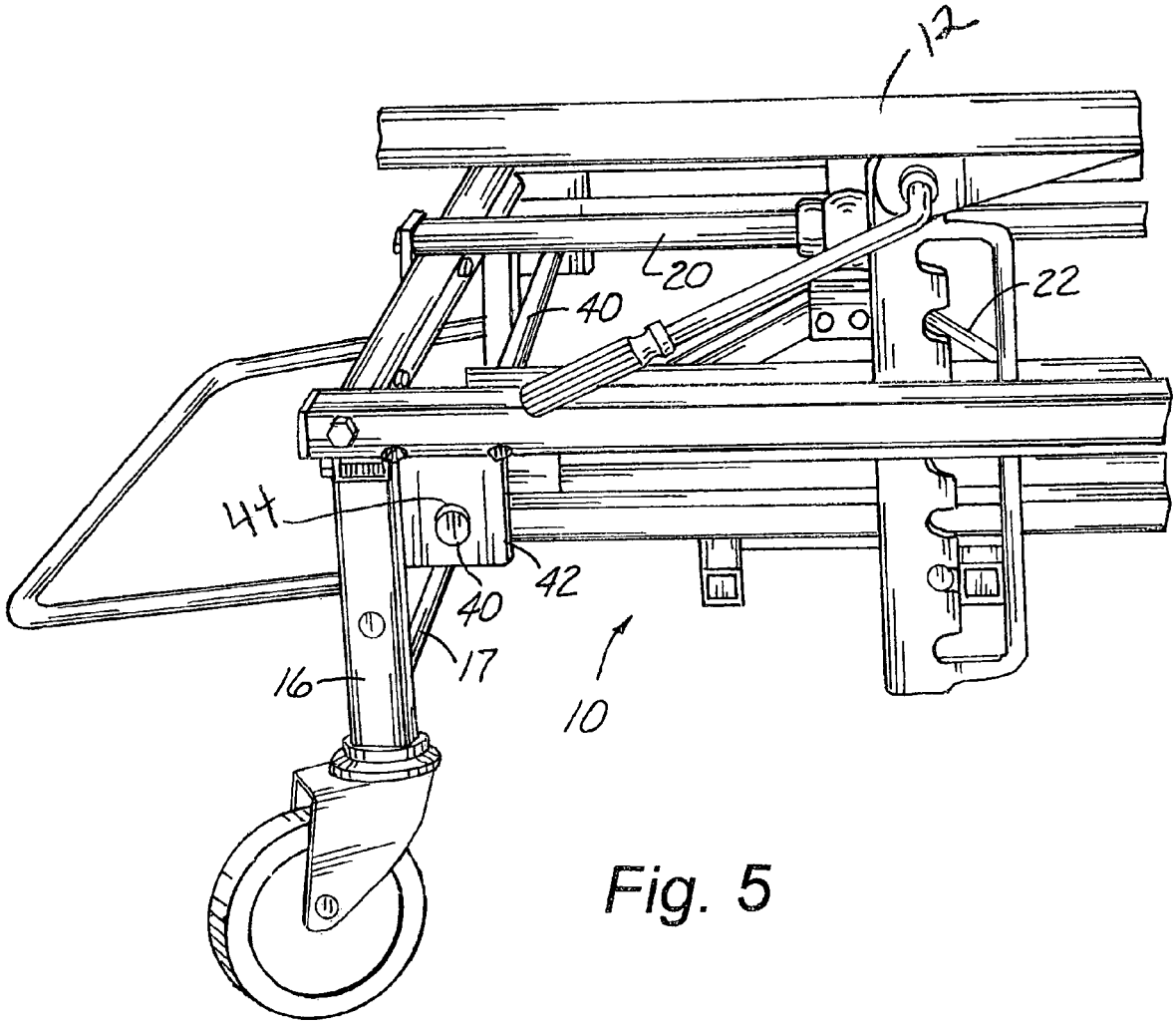
FIG. 5 is a view of an end of the elevating bed of the present invention showing the latching mechanism.
Figure 6:
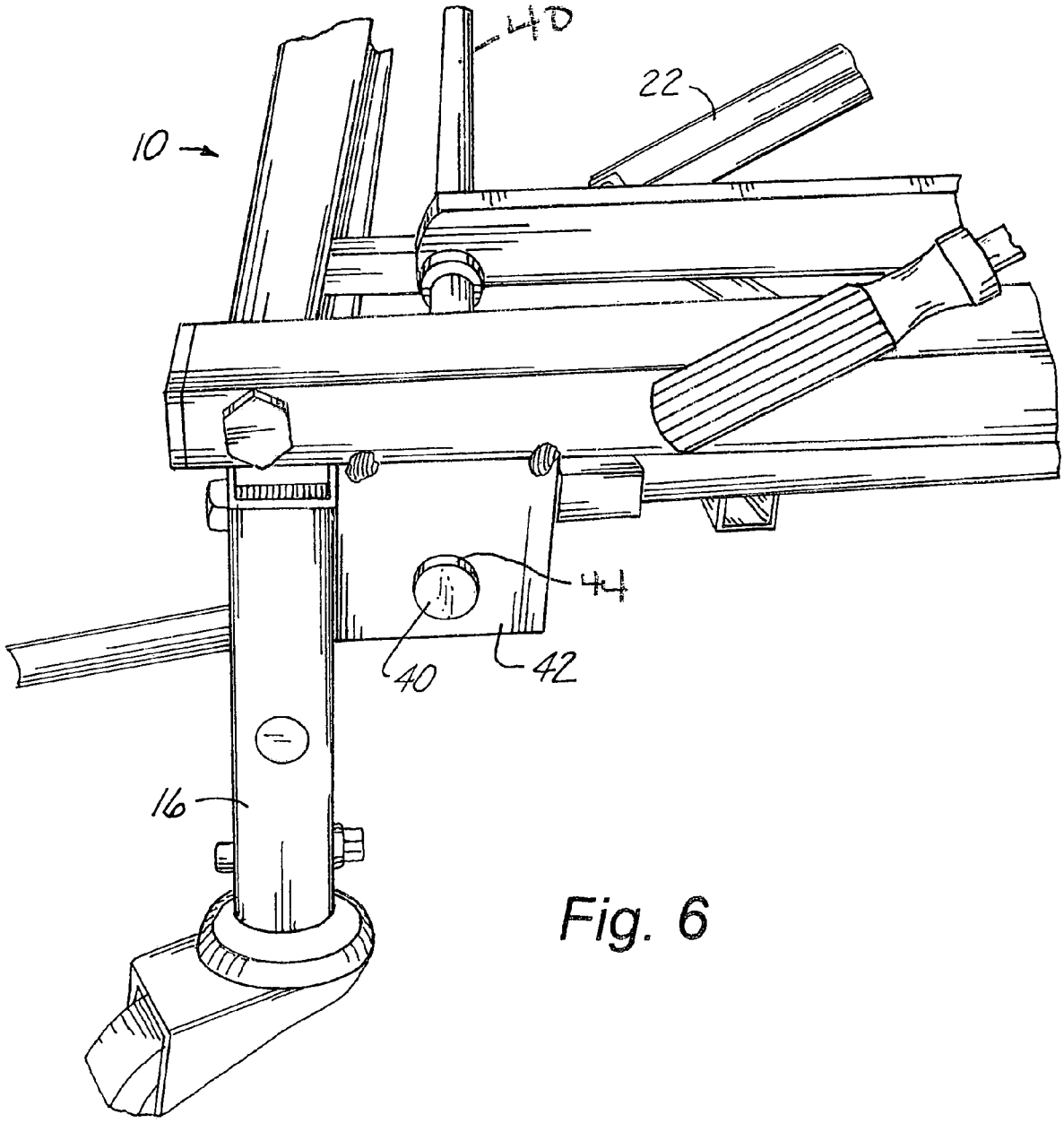
FIG. 6 is a view of the latching mechanism of the present invention.

The side of the bed that is not being raised is fixed into place and thus becomes a pivot defined by a pivot axis. In one embodiment, the side not being raised is fixed in place by a latch system 200 on each end of the bed frame 14. As seen in FIGS. 4-5, a latch bar 40 runs across each end of the bed between two latches 42. The latch bar 40 moves in and out of the latches 42 by an electric actuator 100. The actuator connects to the latch bar 40 by an actuator link 51 that moves as shown by the arrows in FIG. 3. When the bar 40 is inserted into the hole 44 of the latches 42 on the same side of the bed, the bed frame 14 remains fixed in place and cannot be elevated (FIG. 6). On the other side of the bed, the latch bar 40 is not in the latches 42, thus allowing the bed frame 14 to elevate away from the legs section 16 in response to raising of the scissor jacks 22.

FIG. 8 illustrates a lower rod 102 running longitudinally on each side of the bed. The lower rod 102 acts as the pivot point when the opposite side of the bed is raised. When the opposite side is raised, the opening 104 between latches 42 move onto the lower rod 102 to fix that side in place while the opposite side is raised. The lower rods 102 are attached to the lower section 16 of the bed, and run between the head end of the bed and the foot end of the bed.

The action of the scissor jacks 22 on the lifting rod 20 causes each longitudinal side of the bed frame 14 and mattress support platform 12 to be raised. Each side may be raised to an angle of more than 30 degrees. To turn a patient and decrease the pressure between the patient and the mattress, the bed will alternate positions. For example, the left side will be raised for a time period, the bed will return to a horizontal position for a period of time, and the right side of the bed will be raised for a period of time. The timing of the movement and the angle that each side is raised to is variable. These variables may be preset by a controller 60, such as an electric handheld control or other similar means known to those skilled in the art.

In another embodiment, the scissor jacks 22 and electric motor 24 are replaced with a linear drive 50. The linear drive 50 sits on the longitudinal rod 18 of the lower section 16 and is connected to the lifting rod 20. When the linear drive 50 is actuated, it alternatively raises and lowers each longitudinal side of the bed to turn the person.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

The invention claimed is:

1. A bed comprising:

a) a bed frame having a first and a second longitudinal side;

b) a lower section below and supporting said bed frame;

c) a means for raising the bed frame located between the lower section and the bed frame;

d) a latch system for fixing the first longitudinal side of the bed frame to the lower section to act as a first pivot wherein operation of the raising means elevates the second longitudinal side causing the bed frame to tilt about the first pivot, wherein the latch system alternatively fixes the second longitudinal side of the bed frame to the lower section to act as a second pivot wherein operation of the raising means elevates the first longitudinal side causing the bed frame to tilt about the second pivot.

2. The bed of claim 1 wherein the means for raising the bed frame comprises a linear actuator.

3. The bed of claim 1 wherein the means for raising the bed frame comprises a plurality of jacks that raise a lifting rod connected to the bed frame.

4. The bed of claim 3 wherein the jacks are driven by a motor.

5. The bed of claim 1 wherein the latch system is driven by an actuator.

6. The bed of claim 1 wherein the means for raising the bed frame comprises a linear drive.

7. The bed of claim 1 wherein the bed further comprises a mattress support platform connected to the bed frame wherein the mattress support platform rises with the bed frame.

8. The apparatus of claim 1, wherein the latch system further comprises a latch bar running laterally at each end of the bed between a plurality of latches, wherein the latch bar moves in and out of the latches.

9. An apparatus for elevating the sides of a bed comprising a means for raising either longitudinal side of a bed having a bed frame section and a lower section, wherein said means is located between the bed frame section and the lower section and raises the bed frame section while the lower section remains fixed, and further comprising a latch system for fixing one longitudinal side of the bed in place while the other longitudinal side of the bed is elevated.

10. The apparatus of claim 9 wherein the latch system is driven by an actuator.

11. The apparatus of claim 10, wherein the latch system is connected to the actuator by an actuator link.

12. The apparatus of claim 9 wherein the means for raising a longitudinal side of a bed comprises a plurality of jacks that raise a lifting rod connected to the bed frame.

13. The apparatus of claim 12 wherein the jacks are driven by a motor.

14. The apparatus of claim 9 wherein the means for raising a longitudinal side of a bed comprises a linear drive.

15. The apparatus of claim 9 further comprising a control means for causing the sides of the bed to be raised and lowered at predetermined times and to predetermined angles and at predetermined speeds.

16. A method for tilting a bed comprising:

a) providing a bed comprising (i) a bed frame having a first and a second longitudinal side (ii) a lower section below and supporting said bed frame (iii) a means for raising the bed frame located between the lower section and the bed frame; and (iv) a latch system for fixing the first longitudinal side of the bed frame to the lower section wherein operation of the raising means elevates the second longitudinal side causing the bed frame to tilt about a pivot;

b) raising one longitudinal side of the bed for a period of time;

c) returning the bed to a horizontal position for a period of time; and d) raising the other longitudinal side of the bed for a period of time.

* * * * *